US008109832B2

(12) United States Patent
Hsu et al.

(10) Patent No.: US 8,109,832 B2
(45) Date of Patent: Feb. 7, 2012

(54) SIC-BO AUTOMATED DICE-CAGE AND METHOD OF IMPLEMENTING THE SAME

(75) Inventors: Tien-Shu Hsu, Taichung (TW); Shun-Tsung Hsu, Taichung (TW); Ying-Nan Lai, Taichung (TW)

(73) Assignee: Tien-Shu Hsu, Taichung (TW)

( * ) Notice: Subject to any disclaimer, the term of this patent is extended or adjusted under 35 U.S.C. 154(b) by 1006 days.

(21) Appl. No.: 12/044,343

(22) Filed: Mar. 7, 2008

(65) Prior Publication Data

US 2009/0224475 A1 Sep. 10, 2009

(51) Int. Cl.
*A63F 9/24* (2006.01)
*A63F 13/00* (2006.01)

(52) U.S. Cl. ..... 463/47; 463/22; 463/46; 273/148 R; 273/268; 273/309

(58) Field of Classification Search ..... 463/46, 463/47; D21/372; 273/148 R, 309, 268
See application file for complete search history.

(56) References Cited

U.S. PATENT DOCUMENTS 1,702,286 A * 2/1929 Walker ..... 273/145 E
2,269,742 A * 1/1942 Smith ..... 273/145 R
2,462,686 A * 2/1949 Stallard ..... 273/145 D
2,791,432 A * 5/1957 Alvernaz ..... 273/145 R
3,350,098 A * 10/1967 Cromp et al. ..... 273/145 CA
3,356,369 A * 12/1967 Stubbmann ..... 273/145 CA
3,856,307 A * 12/1974 Tinman ..... 273/238
4,892,311 A * 1/1990 Zaitsu ..... 273/145 D
5,259,618 A * 11/1993 Ramos ..... 273/145 C
5,263,715 A * 11/1993 Matsumoto et al. ..... 463/22
5,413,351 A * 5/1995 Franklin ..... 273/274
5,449,174 A * 9/1995 Criner ..... 273/145 C
5,885,157 A * 3/1999 Harada et al. ..... 463/22
5,944,316 A * 8/1999 Hernandez ..... 273/292
6,402,141 B1 * 6/2002 Verstraeten ..... 273/145 C
7,004,836 B2 * 2/2006 Kaminkow et al. ..... 463/20
2006/0033267 A1 * 2/2006 Wong ..... 273/142 R
2007/0029726 A1 * 2/2007 Ohira ..... 273/145 R
2008/0096642 A1 * 4/2008 Yoshizawa ..... 463/22
2008/0248864 A1 * 10/2008 Toyoda ..... 463/22
2009/0186688 A1 * 7/2009 Mourad ..... 463/22
2009/0256310 A1 * 10/2009 Sanchez ..... 273/145 D

* cited by examiner

*Primary Examiner* — Dmitry Suhol
*Assistant Examiner* — Ryan Hsu
(74) *Attorney, Agent, or Firm* — Caesar, Rivise, Bernstein, Cohen & Pokotilow, Ltd.

(57) ABSTRACT

A Sic-bo automated dice-cage has a control module, a dice module and a switch module. The dice module is connected to the control module and has a base, a dice container, multiple dice, a shaker and a cover. The dice container is pellucid and is mounted on the base. The dice are placed in the dice container. The shaker is mounted movably inside the dice container and is controlled by the control module to shake the dice at a variable frequency. The cover selectively covers the dice container and is controlled by the control module to cover and uncover the dice container. The switch module is electronically connected to the control module and comprises actuators to activate the control module to shake the dice, to cover and uncover the dice. The variable frequency of movement of the shaker may further change according to a position of the cover.

13 Claims, 8 Drawing Sheets

SIC-BO AUTOMATED DICE-CAGE AND METHOD OF IMPLEMENTING THE SAME

BACKGROUND OF THE INVENTION

1. Field of Invention

The present invention relates to an automated dice-cage, and more particularly to a Sic-bo automated dice-cage and method of implementing the same.

2. Description of the Related Art

Sic-bo is an old and very popular Chinese dice game. Players can bet on a wide variety of results with odds ranging from 190 to 1 to even. Three dice are rolled and covered then each player places a bet on a variety of things including: dice sum (4-17), a range of dice sums, a combination of two dice, a pair, a triple, a specific triple or whether the dice sum is big (11-17) or small (4-10). Once bets are placed, the dice are shown and a bank pays out.

With reference to FIGS. 7 and 8, a conventional automated dice-cage comprises a base, a dice container (62), an image sensor (66), a rail (67) and two covers (64). The dice container (62) is mounted movably on the base and has a transparent cover, multiple dice disposed movably inside the dice container (62) and is shaken by a croupier. The image sensor (66) is mounted on the transparent cover of the dice container (62) to record dice images and display the images to players. The rail (67) is formed in the base, adjacent to the dice container (62). The two covers (64) are slidably mounted respectively on the rail (67), are slid along the rail (67) by the croupier to cover the dice container (62) before shaking the dice, and slid away from the dice container (62) after bets have been placed to display the dice images.

However dice inside the dice container (62) are hidden from some viewing angles by the covers (64) when the covers (64) are open. Secondly, the dice are shaken inside a covered dice container (62) players may feel bored of, unexcited by and mistrustful of the dice shaking thereby deterring players from placing low-odds bets.

Furthermore, another conventional Sic-bo automated dice-cage has a controller, a dice container, a plunger, a cover and an actuator. The dice container is transparent and has a bottom opening and multiple dice disposed movably inside. The plunger is movably mounted in the dice container through the bottom opening and abuts the dice inside the dice container and is connected to and controlled by the controller to shake the dice. The cover corresponds to and is larger than the dice container, is connected to the controller, is raised by the controller to display the dice inside the dice container to the players and is lowered to cover the dice container before the dice are shaken. The actuator is electronically connected to the controller and is activated by a croupier to signal the controller to lower the cover, to shake dice and to raise the cover.

Although the dice in the Sic-bo automated dice-cage are visible from all viewing angles other problems remain. Since, the dice are hidden when betting, the croupier may skip to shake the dice before raising the cover to allow accomplices to place bets on a known outcome.

Moreover, players cannot see the dice rolling when using the Sic-bo automated dice-cage and this deters people from placing low-odd bets.

The present invention provides a Sic-bo automated dice-cage to obviate or mitigate the shortcomings of the conventional Sic-bo automated dice-cage.

SUMMARY OF THE INVENTION

The primary objective of the present invention is to provide a Sic-bo automated dice-cage and method of shaking dice in the dice-cage to raise enjoyment and prevent a croupier cheating.

The Sic-bo automated dice-cage has a control module, a dice module and a switch module. The dice module is connected to the control module and has a base, a dice container, multiple dice, a shaker and a cover. The dice container is pellucid and is mounted on the base. The dice are placed in the dice container. The shaker is mounted movably inside the dice container and is controlled by the control module to shake the dice at a variable frequency. The cover selectively covers the dice container and is controlled by the control module to cover and uncover the dice container. The switch module is electronically connected to the control module and comprises actuator to activate the control module to shake the dice, to cover and uncover the cover. The variable frequency of movement of the shaker may further change according to a position of the cover.

Other objectives, advantages and novel features of the invention will become more apparent from the following detailed description when taken in conjunction with the accompanying drawings.

DETAILED DESCRIPTION OF THE INVENTION

Figure 1:
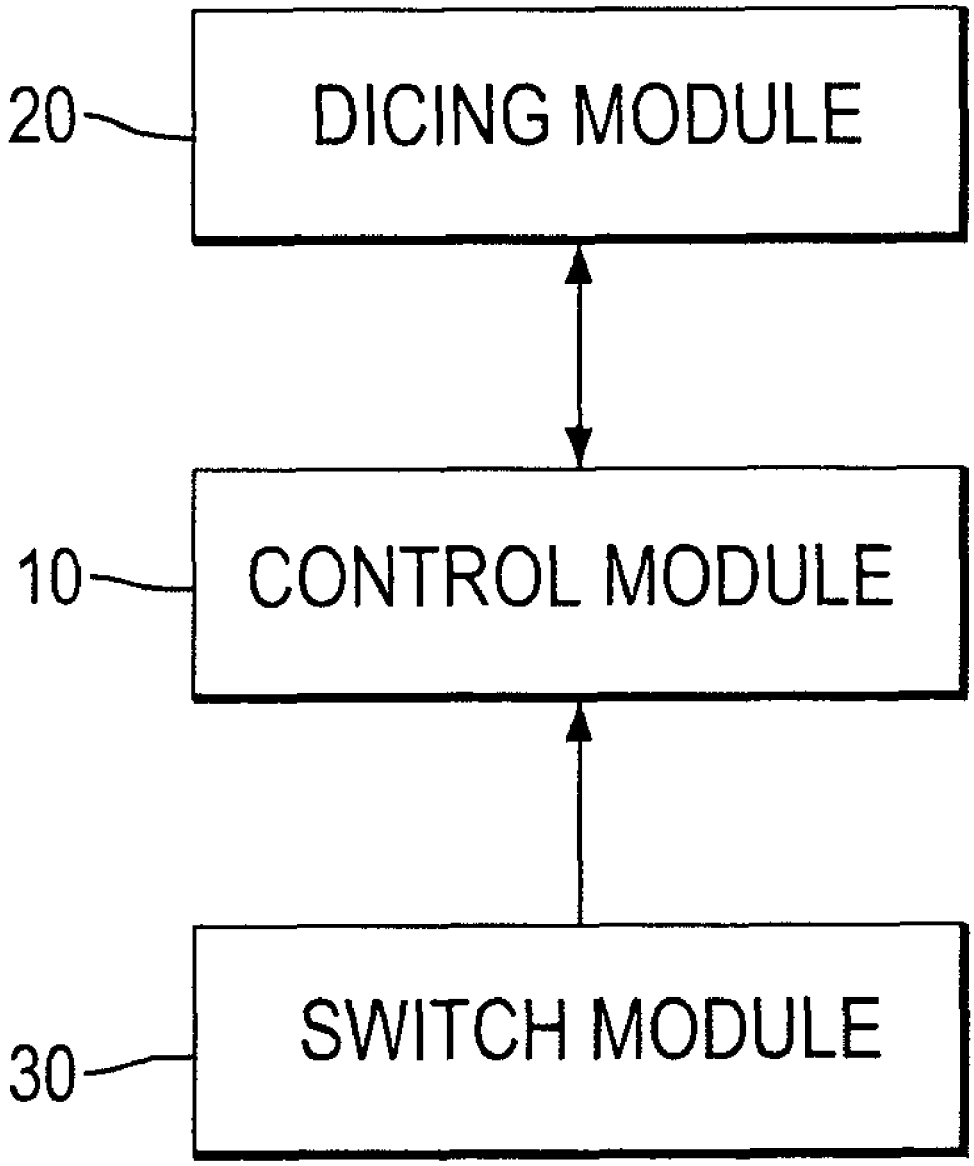
FIG. 1 is a block diagram of a first embodiment of a Sic-bo automated dice-cage in accordance with the present invention.
Figure 2:
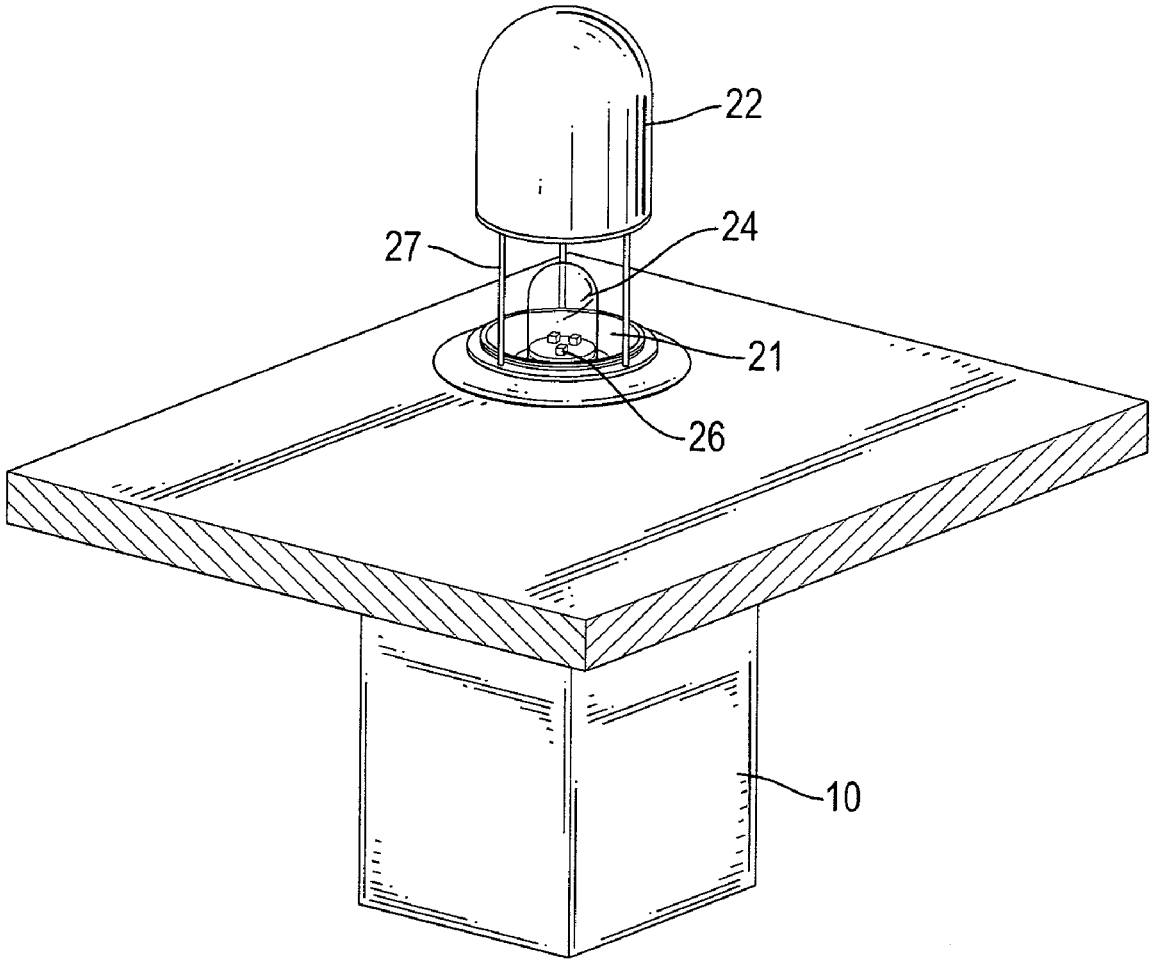
FIG. 2 is a perspective view of the Sic-bo automated dice-cage in FIG. 1.
Figure 3:
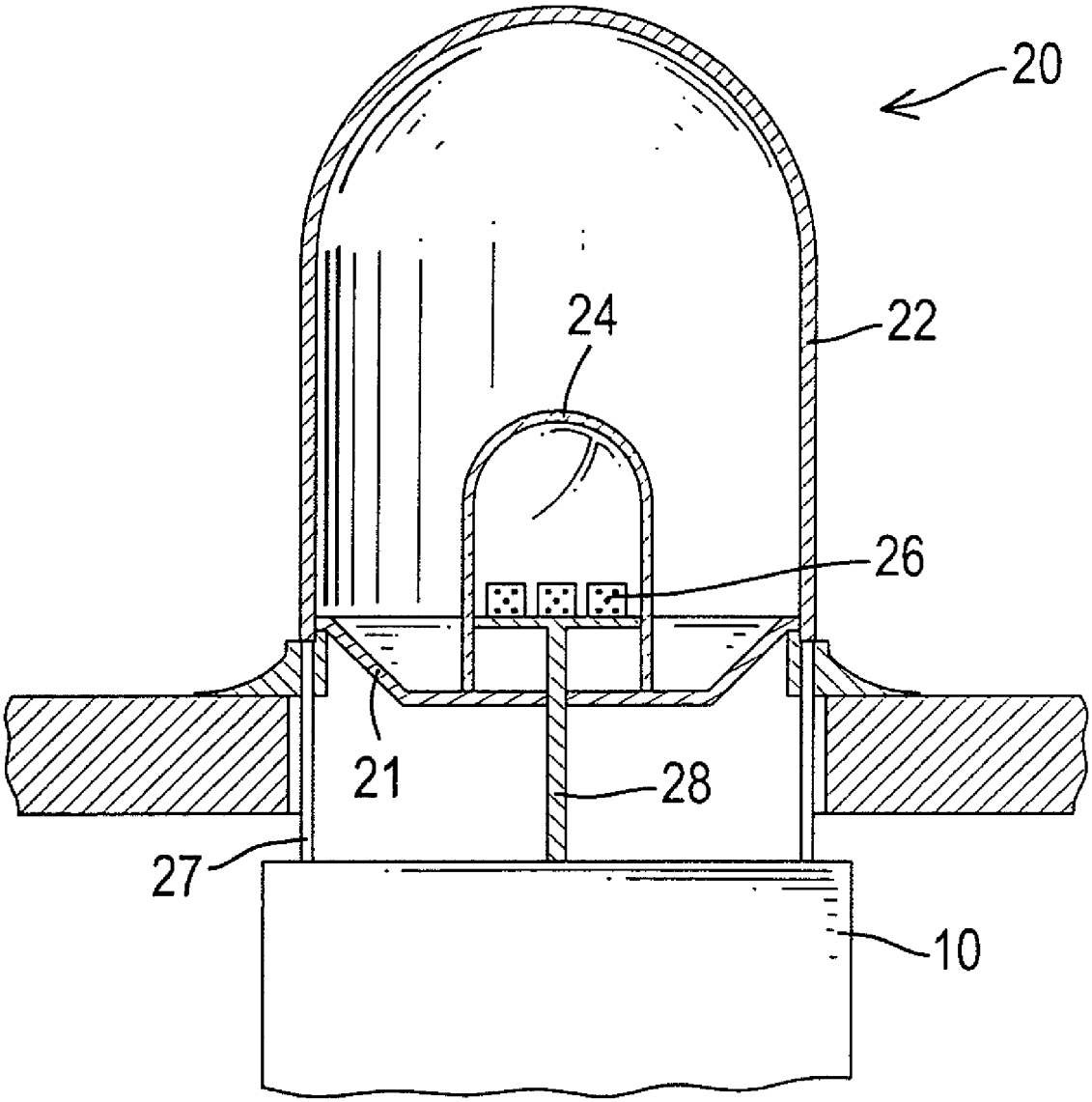
FIG. 3 is an enlarged view in partial section of the Sic-bo automated dice-cage in FIG. 1.

With reference to FIGS. 1, 2, 3 and 5, a Sic-bo automated dice-cage comprises a control module (10), a dice module (20), a switch module (30) and an optional sensor (29).

The control module (10) is an electrical module for controlling connected apparatuses.

The dice module (20) is connected to the control module (10) and has a base (21), a dice container (24), a shaker (28), multiple dice (26), a frame (27) and a cover (22).

The base (21) may be a disc, has a top surface and may be attached to a tabletop.

The dice container (24) is a pellucid container, may be a domed cylinder and has an opening and an inner surface. The opening of the dice container (24) is mounted on the top surface of the base (21).

The shaker (28) has a shaft. The shaft has a distal end and a proximal end and may further have a plunger formed on the distal end and mounted slidably against the inner surface of the dice container (24) or a bar formed on and protruding from the distal end of the shaft being rotated. The proximal end of the shaft is controlled to move under a variable frequency, is movably connected to the control module (10) and the shaft may rotate or reciprocate. The distal end of the shaker (28) is mounted through the base (21) and disposed in the dice container (24) and is controlled by the control module (10) to move inside the inner cup (24) under the variable frequency.

The variable frequency is a number of cycles, rotations or the like that the shaker (28) is moved in a given time.

The multiple dice (26) are mounted in the dice container (24) and movably mounted adjacent to the distal end of the shaker (28), are shaken by the shaker (28) when the shaker (28) is moving, and may be changeably shaken according to the variable frequency to provide a random result.

The frame (27) comprises at least one rod and is mounted slidably through the base (21) and is connected to and moved by the control module (10) and has a mounting end. In a preferred embodiment of the prevent invention, the frame (27) comprises three parallel rods.

The cover (22) corresponds to and is selectively mounted slidably around the dice container (24), is opaque, connected to the mounting end of the frame (27) and has an opening. The cover (22) selectively covers the dice container (24) and is raised above the dice container (24) by the frame (27) when the control module (10) changes position of the frame (27).

The switch module (30) is electronically connected to the control module (10), is activated to drive the control module (10) to adjust position of the cover (22) and to shake the dice (26), may activate the control module (10) to shake dice (26) in a Sic-Bo shaking method, and may have actuators comprising covering the dice container with shaking the dice actuator (32) and uncovering the cover actuator (34).

The covering the dice container with shaking the dice actuator (32) may be an electrical push bottom, selectively activates the control module (10) to gradually move the frame (27) to cover the dice container (24) when the shaker (28) is activated to shake the dice (26).

The uncovering the dice container actuator (34) may be an electrical push bottom, selectively activates the control module (10) to move the frame (27) to uncover the dice module.

The sensor (29) is mounted on the inner surface of the dice container (24), is electronically connected to the control module (10) and detects a position of the cover (22) and transmits the position of the cover (22) to the control module (10) to change the variable frequency of the shaker (28). The sensor (29) may detect height of the cover (22) relative to the base (21), brightness inside the dice container (24) or the like, may further capture images of the dice (26) and be an optical distance sensor, a brightness sensor, an image sensor with a brightness sensor or the like. The sensor (29) transmits the height or brightness to the control module (10) and the variable frequency may be changed by the control module (10) by a direct ratio to the height or brightness.

In the preferred embodiment, the sensor (29) is an image sensor with a brightness sensor (29), the sensor (29) detects the brightness inside the cover (22), and the control module (10) to change the variable frequency of the shaker (28) in direct ratio to the brightness. Therefore, as the cover (22) covers the dice container (24), the frequency of the shaker (28) slows down.

Figure 4:
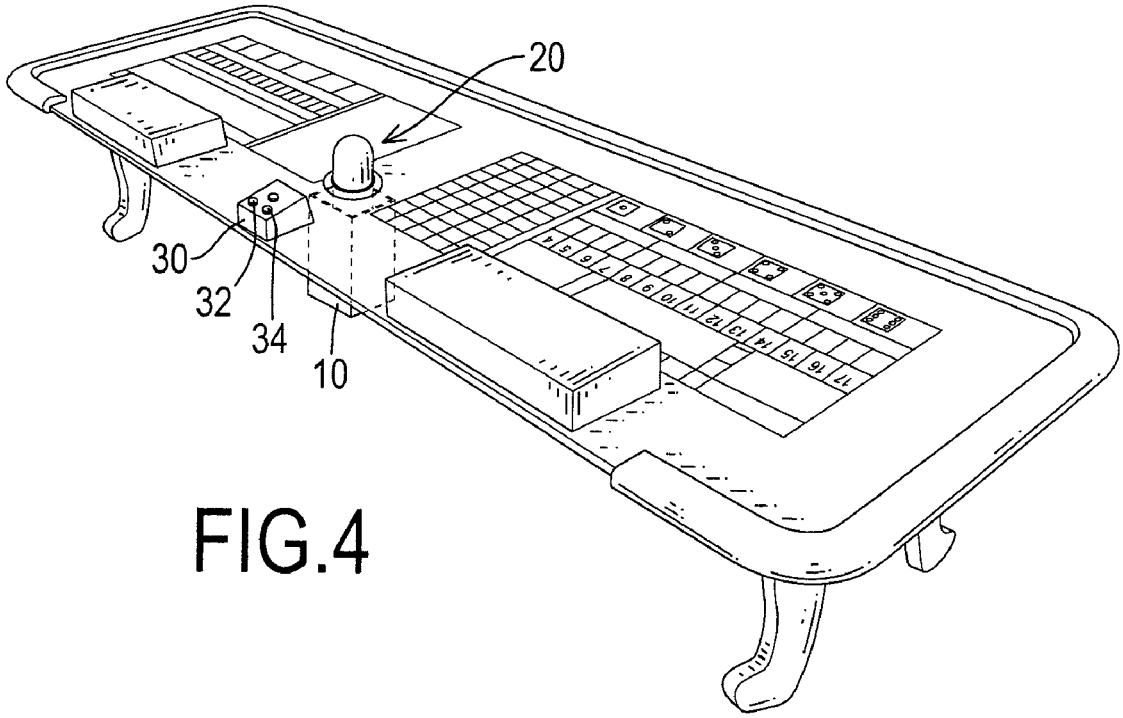
FIG. 4 is an operational perspective view of the Sic-bo automated dice-cage in FIG. 1.
Figure 5:
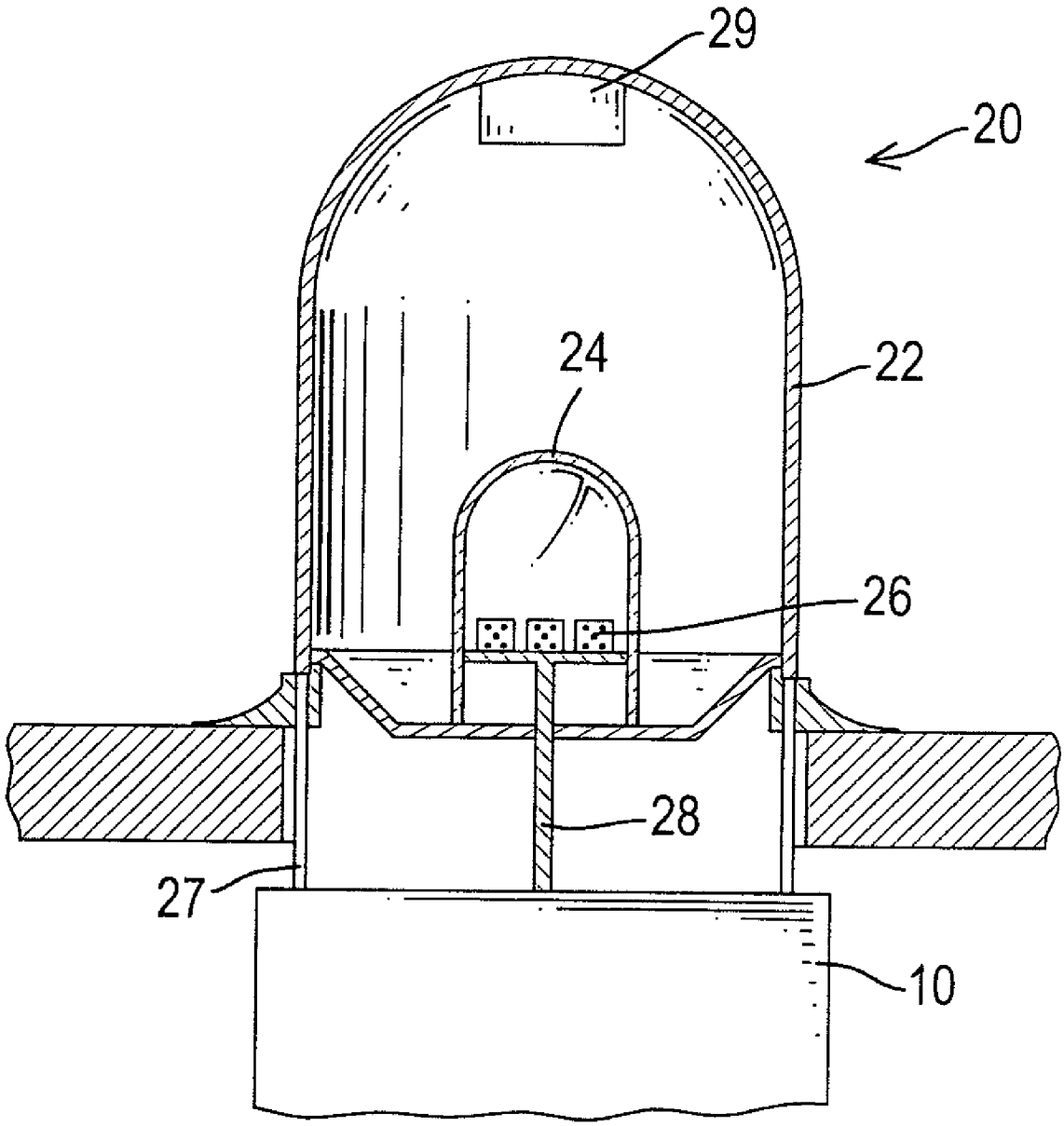
FIG. 5 is an enlarged perspective view of the Sic-bo automated dice-cage in FIG. 1, implemented with an optical reader.

With further reference to FIG. 4, the base (21) and the switch module (30) may be mounted on a croupier table. A croupier activates the shaking process by pressing the shaking process actuator (32) thereby activating the control module (10) to activate the shaker (28) and the shaker (28) shakes the dice (26) at the variable frequency, then the control module (10) activates the frame (27) and the cover (22) moves to gradually cover the dice container (24). As the dice container (24) is covered, the variable frequency of the shaker may decrease and slow down movement of the dice (26). When the cover (22) completely covers the dice container (24), the variable frequency of the shaker (28) slows to a stop and the dice also stop. All players seated around the croupier table can see the rolling dice slow down and once the dice (26) are completely covered may bet on the Sic-bo game. Then the frame (27) is activated by the control module (10) to move the cover (22) and reveal the dice (26) to all players. Because the players see the dice (26) moving they may be enticed to bet more money on riskier bets, especially when they see the dice (26) slowing down and may see a certain number combination face up.

Figure 6:
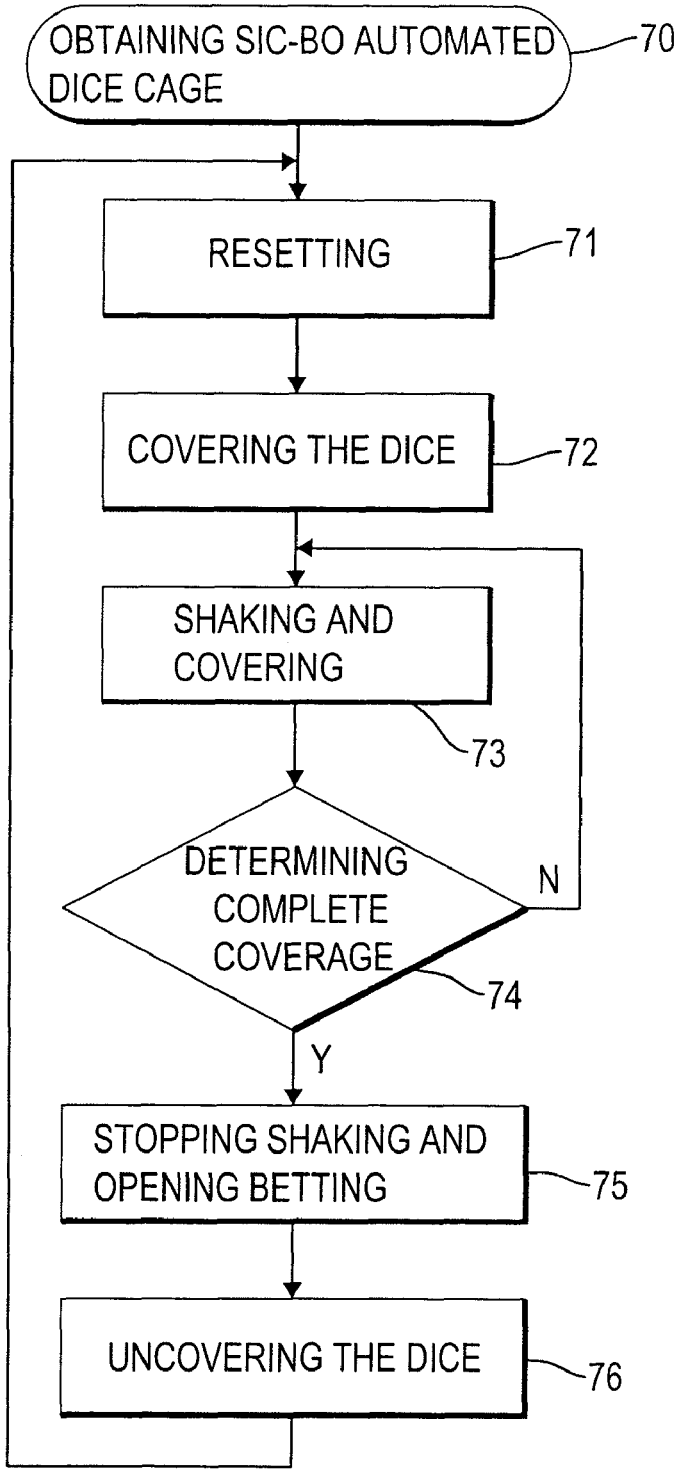
FIG. 6 is a flow chart of a Sic-bo shaking method in accordance with the present invention.
Figure 7:
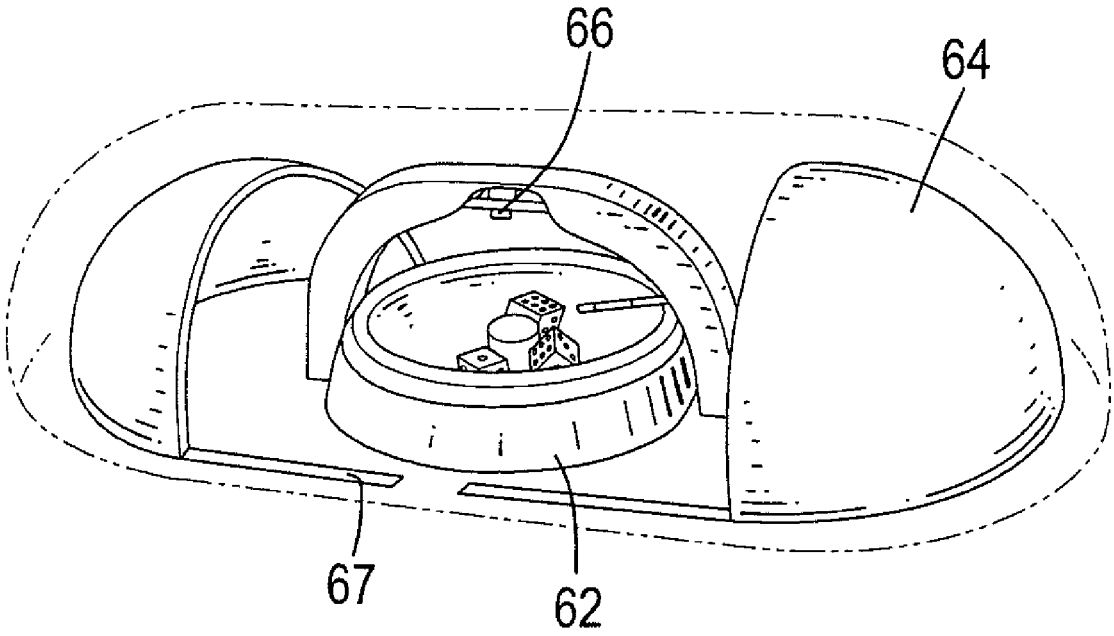
FIG. 7 is a perspective view of a conventional automated dice-cage in accordance with the prior art.
Figure 8:
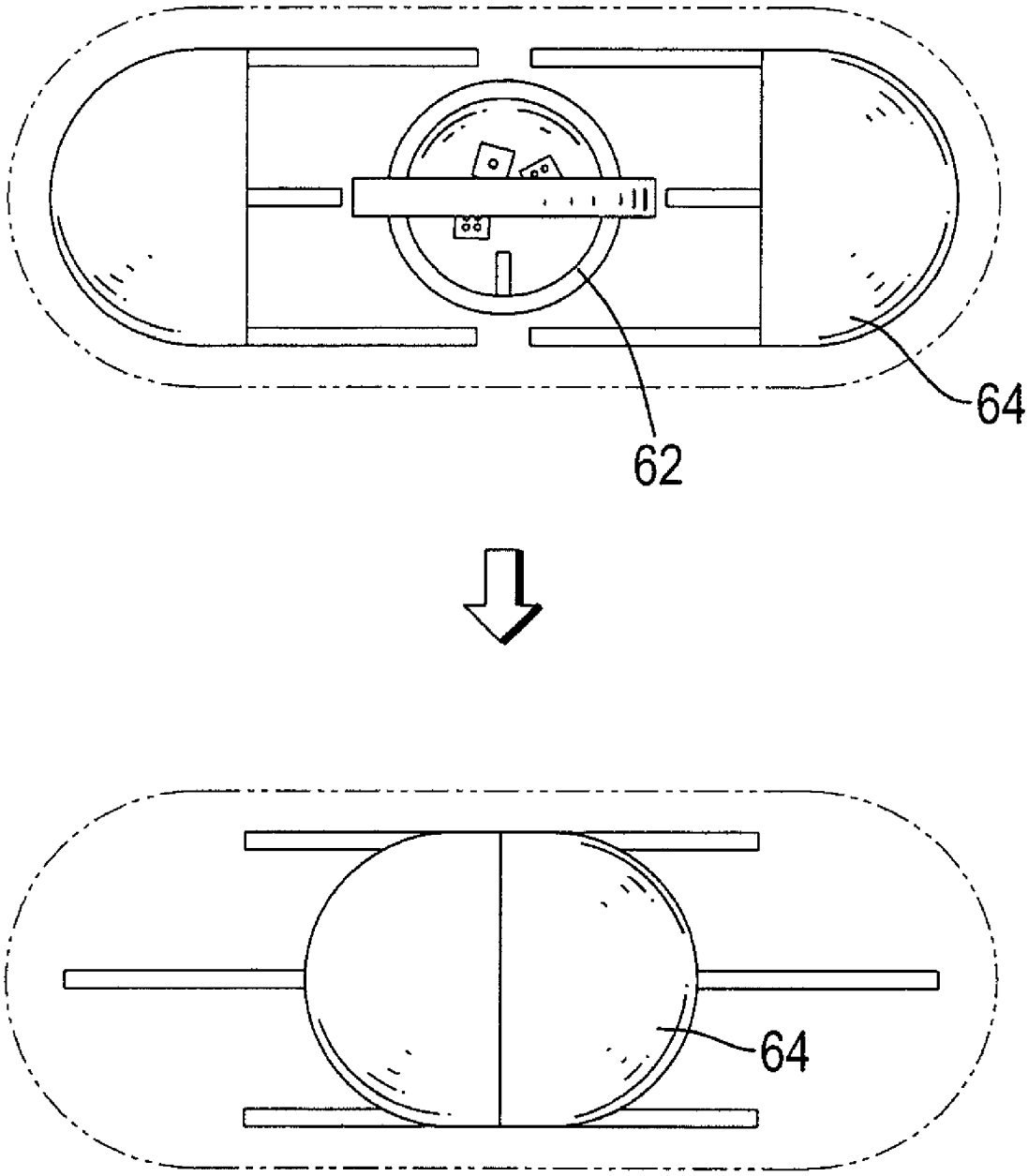
FIG. 8 is an operational top view of the automated dice-cage in FIG. 7.

With reference to FIG. 6, the Sic-bo shaking method comprises steps of obtaining a Sic-bo automated dice cage (70), resetting (71), covering the dice (72), shaking and covering (73), determining complete coverage (74), stopping shaking and opening betting (75) and uncovering the dice (76).

In the step of resetting (71), the control module (10) moves the cover (22) to a highest position.

In the step of covering the dice (72), the control module (10) is activated to gradually move the cover (22) to cover the dice container (24).

In the step of shaking and covering (73), the control module (10) moves the shaker (28) in a variable frequency to shake the dice inside the dice container (24) at a changeable speed while moving the cover (22) over the dice container (24). The variable frequency corresponds to the position of the cover (72) and may be changed by the control module (10) by a direct ratio to the height or brightness.

In the step of determining complete coverage (74), the control module (10) determines whether the cover (22) has covered the dice container (24) completely by receiving transmission from the sensor (29). If the cover (22) does not completely cover the dice container (24), then the step of shaking and covering (73) is repeated, if the cover (22) completely covers the dice container (24), the step of stopping shaking and opening betting (75) is activated.

In the step of stopping shaking and opening betting (75), the control module (10) stops shaking the dice (26) and players are allowed to bet on the dice (26).

In the step of uncovering the dice (76), the control module (10) uncovers the dice (26) for players and a bank may pay out.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A Sic-bo automated dice-cage comprising:

a control module being an electrical module for controlling connected mechanical apparatuses; a dice module being connected to the control module and having a base having a top surface;

a dice container being a pellucid container and having an opening being mounted on the top surface of the base; and an inner surface;

a shaker controlled to move inside the dice container at a variable frequency and having a shaft, the shaft having a proximal end being movably connected to the control module; and a distal end being mounted through the base and disposed in the dice container and being controlled by the control module to move inside the dice container;

multiple dice being mounted in the dice container and movably mounted adjacent to the distal end of the shaker, being shaken by the shaker changeably according to the variable frequency to provide a random result when the shaker is moving;

a frame being mounted slidably through the base and being connected to and moved by the control module and comprising a mounting end; and at least one rod; and a cover corresponding to, being larger than and selectively mounted slidably around the dice container, being opaque, being connected to the mounting end of the frame and having an opening;

a switch module being electronically connected to the control module, being activated to drive the control module to adjust position of the cover and shake the dice; and a sensor being mounted on the inner surface of the dice container, being electronically connected to the control module and being an optical distance sensor sensing a height of the cover relative to the base and transmitting the height to the control module, wherein the control module changes the variable frequency in a direct ratio to the height.

2. The Sic-bo automated dice-cage as claimed in claim 1, wherein the switch module has actuators comprising covering the dice container with shaking the dice actuator selectively activating the control module to move the frame to cover the dice container when the shaker is activated to shake the dice; and uncovering the cover actuator selectively activating the control to move the frame uncovering the dice container.

3. The Sic-bo automated dice-cage as claimed in claim 1, wherein the frame has three parallel rods.

4. A Sic-bo automated dice-cage comprising a control module being an electrical module for controlling connected mechanical apparatuses; a dice module being connected to the control module and having a base having a top surface;

a dice container being a pellucid container and having an opening being mounted on the top surface of the base; and an inner surface;

a shaker controlled to move inside the dice container at a variable frequency and having a shaft, the shaft having a proximal end being movably connected to the control module; and a distal end being mounted through the base and disposed in the dice container and being controlled by the control module to move inside the dice container;

multiple dice being mounted in the dice container and movably mounted adjacent to the distal end of the shaker, being shaken by the shaker changeably according to the variable frequency to provide a random result when the shaker is moving;

a frame being mounted slidably through the base and being connected to and moved by the control module and comprising a mounting end; and at least one rod; and a cover corresponding to, being larger than and selectively mounted slidably around the dice container, being opaque, being connected to the mounting end of the frame and having an opening;

a switch module being electronically connected to the control module, being activated to drive the control module to adjust position of the cover and shake the dice; and a sensor being mounted on the inner surface of the dice container, being electronically connected to the control module and being a brightness sensor sensing brightness inside the cover and transmitting the brightness to the control module, wherein the control module changes the variable frequency by a direct ratio to the brightness.

5. A Sic-bo automated dice-cage comprising a control module being an electrical module for controlling connected mechanical apparatuses; a dice module being connected to the control module and having a base having a top surface;

a dice container being a pellucid container and having an opening being mounted on the top surface of the base; and an inner surface;

a shaker controlled to move inside the dice container at a variable frequency and having a shaft, the shaft having a proximal end being movably connected to the control module; and a distal end being mounted through the base and disposed in the dice container and being controlled by the control module to move inside the dice container;

multiple dice being mounted in the dice container and movably mounted adjacent to the distal end of the shaker, being shaken by the shaker changeably according to the variable frequency to provide a random result when the shaker is moving;

a frame being mounted slidably through the base and being connected to and moved by the control module and comprising a mounting end; and at least one rod; and a cover corresponding to, being larger than and selectively mounted slidably around the dice container, being opaque, being connected to the mounting end of the frame and having an opening;

a switch module being electronically connected to the control module, being activated to drive the control module to adjust position of the cover and shake the dice; and a sensor being mounted on the inner surface of the dice container, being electronically connected to the control module and being an image sensor with a brightness sensor being capable of capturing an image of the dice and sensing a brightness inside the cover and transmitting the image and brightness to the control module, wherein the control module changes the variable frequency by a direct ratio to the brightness.

6. A Sic-bo shaking method, comprises steps of obtaining a Sic-bo automated dice-cage comprising a control module being an electrical module for controlling connected mechanical apparatuses;

a dice module being connected to the control module and having a base having a top surface;

a dice container being a pellucid container and having an opening being mounted on the top surface of the base; and an inner surface; and a shaker controlled to move inside the dice container at a variable frequency and having a shaft, the shaft having a proximal end being movably connected to the control module; and a distal end being mounted through the base and disposed in the dice container and being controlled by the control module to move inside the dice container;

multiple dice being mounted in the dice container and movably mounted adjacent to the distal end of the shaker, being shaken by the shaker changeably according to the variable frequency to provide a random result when the shaker is moving;

at least one frame being mounted slidably through the base and being connected to and moved by the control module and comprising a mounting end; and at least one rod; and a cover corresponding to, being larger than and selectively mounted slidably around the dice container, being opaque, being connected to the mounting end of the frame and having an opening; and a switch module being electronically connected to the control module, being activated to drive the control module to adjust position of the cover and shake the dice; and a sensor being mounted on the inner surface of the dice container, being electronically connected to the control module, detecting brightness inside the cover and sending the brightness to the control module, wherein the control module changes the variable frequency in direct ratio to the brightness;

resetting, being the control module moving the cover to a highest position;

covering the dice, being the control module being activated and gradually moving the cover to cover the dice container;

shaking and covering the cover, being the control module moving the shaker in the variable frequency to shake the dice inside the dice container at a changeable speed while moving the cover over the dice container;

determining complete coverage, being the control module determining the cover is being covered by the dice container completely by detecting results of the sensor;

stopping shaking and opening betting, being the control module stopping shaking the dice and players being allowed to bet on the dice; and uncovering the dice, being the control module uncovering the dice for players.

7. The Sic-bo dicing method as claimed in claim 6, wherein the changeable speed corresponds to a position of the cover determined by the sensor.

8. A Sic-bo shaking method, comprises steps of obtaining a Sic-bo automated dice-cage comprising a control module being an electrical module for controlling connected mechanical apparatuses;

a dice module being connected to the control module and having a base having a top surface;

a dice container being a pellucid container and having an opening being mounted on the top surface of the base; and an inner surface; and a shaker controlled to move inside the dice container at a variable frequency and having a shaft, the shaft having a proximal end being movably connected to the control module; and a distal end being mounted through the base and disposed in the dice container and being controlled by the control module to move inside the dice container;

multiple dice being mounted in the dice container and movably mounted adjacent to the distal end of the shaker, being shaken by the shaker changeably according to the variable frequency to provide a random result when the shaker is moving;

at least one frame being mounted slidably through the base and being connected to and moved by the control module and comprising a mounting end; and at least one rod; and a cover corresponding to, being larger than and selectively mounted slidably around the dice container, being opaque, being connected to the mounting end of the frame and having an opening; and a switch module being electronically connected to the control module, being activated to drive the control module to adjust position of the cover and shake the dice; and a sensor being mounted on the inner surface of the dice container, being electronically connected to the control module, detecting height of the cover and sending the height to the control module, wherein the control module changes the variable frequency in direct ratio to the height;

resetting, being the control module moving the cover to a highest position;

covering the dice, being the control module being activated and gradually moving the cover to cover the dice container;

shaking and covering the cover, being the control module moving the shaker in the variable frequency to shake the dice inside the dice container at a changeable speed while moving the cover over the dice container;

determining complete coverage, being the control module determining the cover is being covered by the dice container completely by detecting results of the sensor;

stopping shaking and opening betting, being the control module stopping shaking the dice and players being allowed to bet on the dice; and uncovering the dice, being the control module uncovering the dice for players.

9. The Sic-bo automated dice-cage as claimed in claim 4, wherein the switch module has actuators comprising covering the dice container with shaking the dice actuator selectively activating the control module to move the frame to cover the dice container when the shaker is activated to shake the dice; and uncovering the cover actuator selectively activating the control to move the frame uncovering the dice container.

10. The Sic-bo automated dice-cage as claimed in claim 9, wherein the frame has three parallel rods.

11. The Sic-bo automated dice-cage as claimed in claim 5, wherein the switch module has actuators comprising covering the dice container with shaking the dice actuator selectively activating the control module to move the frame to cover the dice container when the shaker is activated to shake the dice; and uncovering the cover actuator selectively activating the control to move the frame uncovering the dice container.

12. The Sic-bo automated dice-cage as claimed in claim 11, wherein the frame has three parallel rods.

13. The Sic-bo dicing method as claimed in claim 8, wherein the changeable speed corresponds to a position of the cover determined by the sensor.

* * * * *